US005590927A

United States Patent [19]

Rapphahn

[11] Patent Number: 5,590,927

[45] Date of Patent: Jan. 7, 1997

[54] FOLD-AWAY HIGH CHAIR

[76] Inventor: Daniel A. Rapphahn, R.R. 1 Box 13 Middletown Rd., Londonderry, Vt. 05148

[21] Appl. No.: 367,896

[22] Filed: Jan. 3, 1995

[51] Int. Cl.[6] ..... A47C 9/06

[52] U.S. Cl. ..... 297/143; 297/217.1; 297/14

[58] Field of Search ..... 297/14, 140, 143, 297/153, 217.1, 217.7; D6/336, 339

[56] References Cited

U.S. PATENT DOCUMENTS

| | | | |
|---|---|---|---|
| 1,369,633 | 2/1921 | Dietrich et al. | 297/14 X |
| 2,666,473 | 1/1954 | Dean | 297/143 X |
| 2,956,617 | 10/1960 | Bruderer et al. | 297/143 X |
| 3,160,437 | 12/1964 | Hill | 297/143 |
| 3,170,199 | 2/1965 | Martin | 297/14 X |
| 3,977,722 | 8/1976 | Gist | 297/143 |
| 4,723,813 | 2/1988 | Kassai | 297/153 |
| 4,815,732 | 3/1989 | Mahvi | 272/143 X |

FOREIGN PATENT DOCUMENTS

| | | | |
|---|---|---|---|
| 528850 | 4/1957 | Belgium | 297/143 |
| 2740130 | 3/1979 | Germany | 297/143 |
| 139107 | 2/1920 | United Kingdom | 297/143 |

*Primary Examiner*—Peter M. Cuomo
*Assistant Examiner*—David E. Allred

[57] ABSTRACT

A baby highchair designed to be stored in a shallow storage compartment, which may be a conventional drawer, and when slid out therefrom to unfold and to lock into a rigid structure adapted to support a child therein. The unit engages with conventional full drawer extension slides mounted in the compartment permitting the unit to be slid in or out when in its folded configuration. The compartment may be further modified to provide a hinged closure for the front thereof which swings upwardly to permit entry into or exit from the compartment. The unit is designed to both save space and expense and is preferably installed in a kitchen drawer. The compartment may also be formed by a bracket member adapted to be bolted or otherwise fastened to the underside of a kitchen table, shelf or the like. Except for steel hinges, the unit is preferably formed from easily-cleaned, smooth plastic materials.

3 Claims, 5 Drawing Sheets

FOLD-AWAY HIGH CHAIR

BACKGROUND OF THE INVENTION

1. Field of the Invention

The present invention relates to children's highchairs and more particularly pertains to such a chair which may be folded for sliding storage in a compartment which also cooperates to support such highchair in its operative position.

2. Description of the Prior Art

The use of folding highchairs is known in the prior art. More specifically, such devices heretofore devised and utilized for the purpose of supporting a child are known to consist basically of familiar, expected and obvious structural configurations, notwithstanding the myriad of designs encompassed by the crowded prior art which have been developed for the fulfillment of countless objectives and requirements. Typical of such designs are those illustrated in U.S. Pat. Nos. 5,165,755; 4,938,603; 4,772,570; DES. 274,581; and DES. 287,196. These all stand on legs of one type or another.

In this respect, the highchair according to the present invention substantially departs from the conventional concepts and designs of the prior art, and in so doing provides a structure primarily developed for the purpose of functioning as a highchair and then storing both out of sight and in a manner not taking up floor space.

Therefore, it can be appreciated that there exists a continuing need for new and improved highchairs which can be easily stored and which have minimal structure thus reducing cost of the unit. In this regard, the present invention substantially fulfills this need.

SUMMARY OF THE INVENTION

In view of the foregoing disadvantages inherent in the known types of highchairs now present in the prior art, the present invention provides an improved highchair construction wherein the same can be stored in and supported by a compartment either in or affixed under a fixture such as a table. As such, the general purpose of the present invention, which will be described subsequently in greater detail, is to provide a new and improved highchair which has all the advantages of the prior art highchairs and none of the disadvantages.

To attain this, the present invention essentially comprises a baby highchair designed to be stored in a shallow storage compartment, which may be a conventional drawer, and when slid out therefrom to unfold and to lock into a rigid structure adapted to support a child therein. The unit engages with conventional full drawer extension slides mounted in the compartment permitting it to be slid in or out when in its folded configuration. The compartment may be further modified to provide a hinged closure therefor which swings upwardly to permit entry into or exit from the drawer. The unit is designed to both save space and expense and is preferably installed in a kitchen drawer. The compartment may also be formed by a bracket member adapted to be bolted or otherwise fastened to the underside of a kitchen table, shelf or the like. Except for steel hinges, the unit is preferably formed from easily-cleaned, smooth plastic materials.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved highchair which has all the advantages of the prior art structures and none of the disadvantages.

It is another object of the present invention to provide a new and improved highchair which may be easily and efficiently manufactured and marketed.

It is a further object of the present invention to provide a new and improved highchair which is of a durable and reliable construction.

An even further object of the present invention is to provide a new and improved highchair which is susceptible of a low cost of manufacture with regard to both materials and labor, and which accordingly is then susceptible of low prices of sale to the consuming public, thereby making such highchairs economically available to the buying public.

Still yet another object of the present invention is to provide a new and improved highchair which provides in the apparatuses of the prior art some of the advantages thereof, while simultaneously overcoming some of the disadvantages normally associated therewith.

Still another object of the present invention is to provide a new and improved highchair which stores out-of-sight.

Yet another object of the present invention is to provide a new and improved highchair which does not take up floor space.

Even still another object of the present invention is to provide a new and improved highchair which utilizes a minimum of structural parts thereby keeping the cost of the unit down.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
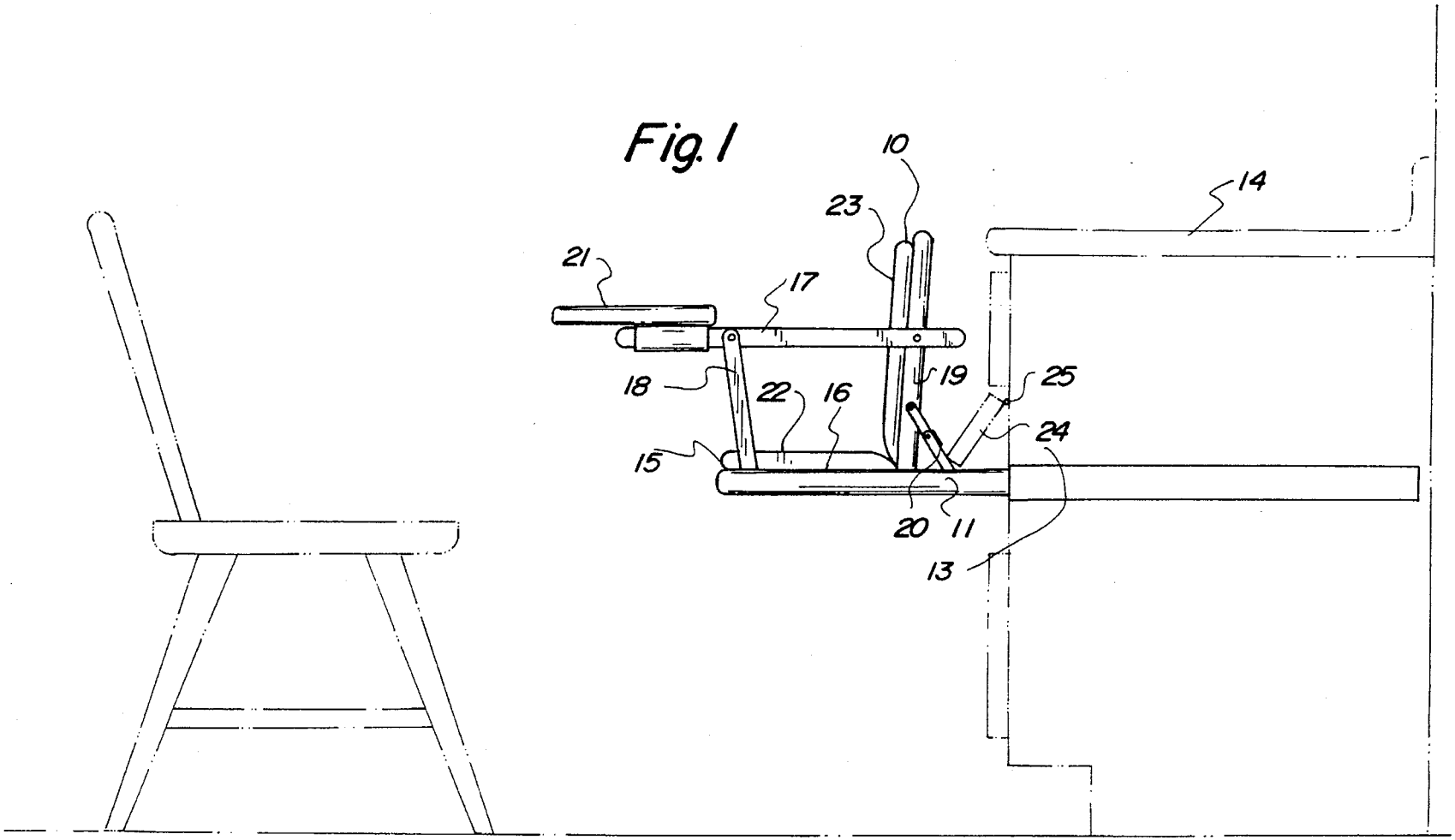
FIG. 1 is a side elevation showing a device of the present invention in operative position.
Figure 3:
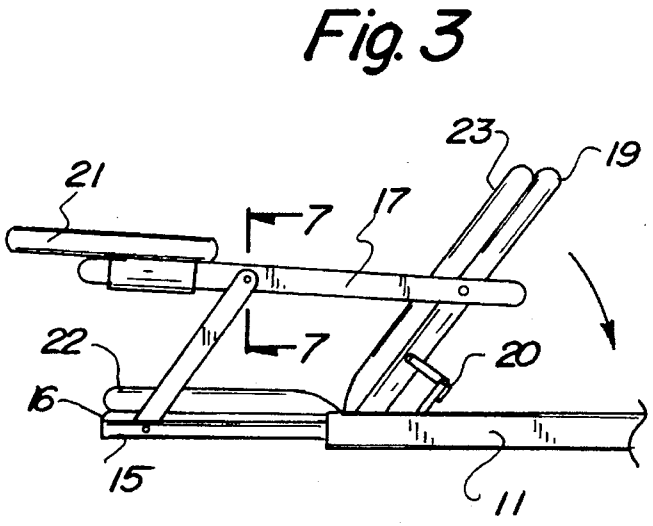
FIG. 3 is a side view showing such device partially folded.
Figure 2:
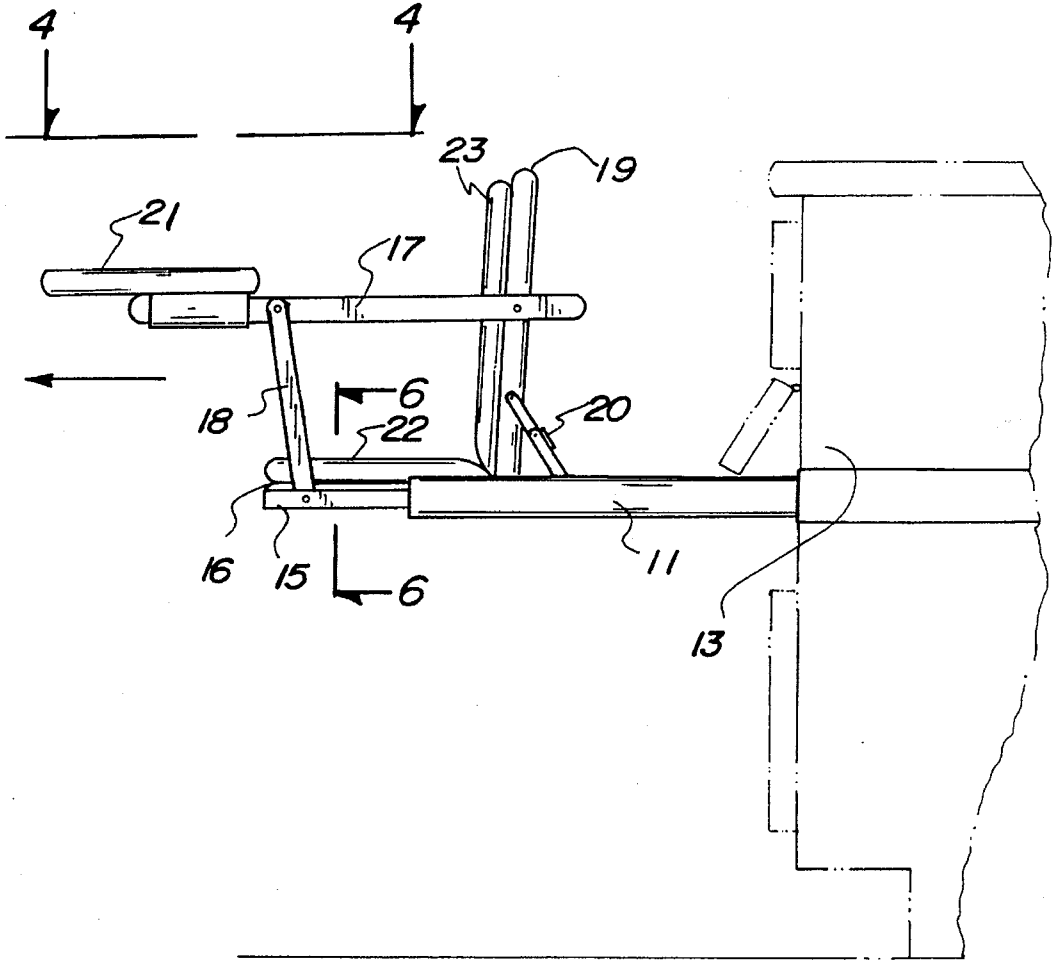
FIG. 2 is a side plan view showing the manner in which such device slides out.

With reference now to the drawings, and in particular to FIGS. 1, 2 and 3 thereof, a new and improved highchair unit embodying the principles and concepts of the present invention and generally designated by the reference numeral 10 will be described.

More specifically, it will be noted that at first glance the most striking feature of the unit 10 is the absence of the usual legs associated with a highchair. In place thereof is a cooperative engagement between unit 10 and a pair of drawer slides 11 mounted within a storage compartment, here shown as a drawer 13 of a kitchen counter 14 or the like. The drawer 13 thus serves to both support the unit 10 in its extended or operative position as shown in these Figures and to provide compact out-of-sight storage therefor when in its collapsed or storage position.

Unit 10 has a pair of elongated base members 15 slideably mounted within drawer slides 11 as more clearly shown in FIG. 6 below and connected to each other by a seat member 16. Extending parallel with and superposed above members 15 are a pair of tray and arm support members 17. Interconnecting these two sets of members are a pair of hinged support arms 18 and a hinged back rest member 19. The hinge 20 connected to back rest member 19 is of the two-piece snap lock type, requiring deliberate release to permit folding thereof as shown in FIG. 3. Members 15 are pivotally connected to both support arms 18 and to back rest member 19. Adapted to snap on to the upper tray and arm support members 17 is a rectangular feeding tray 21. A padded seat cushion 22 and back cushion 23 is also preferably used with unit 10 as is a conventional seat or safety belt (not shown).

In addition to the installation of drawer slides 11, if necessary, the door or closure 24 for drawer 13 preferably requires modification to provide a hinge 25 at the upper edge thereof, thereby permitting such door 24 to hinge upwardly to open for extension or retraction of unit 10.

Figure 4:
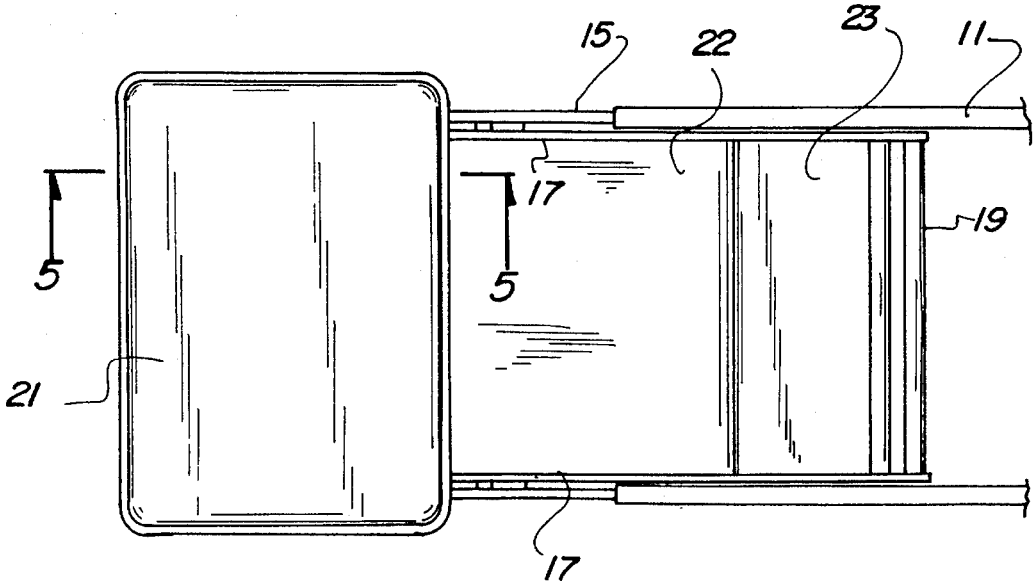
FIG. 4 is a top plan view taken on line 4—4 of FIG. 2.
Figure 5:
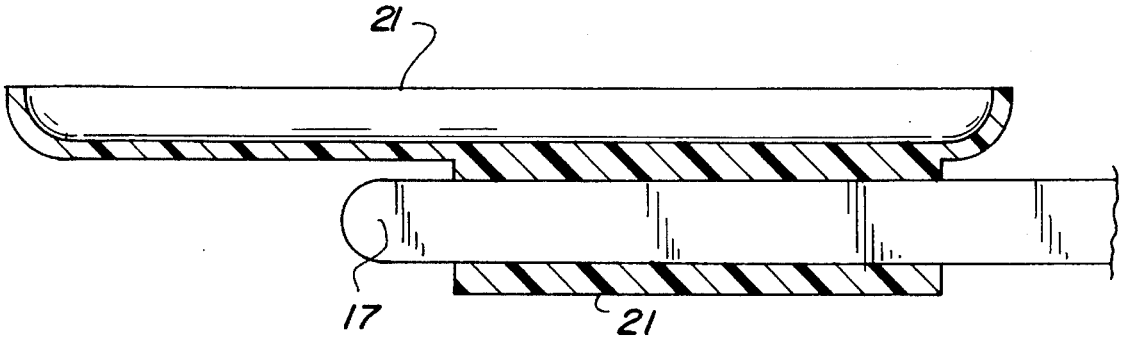
FIG. 5 is a sectional view on line 5—5 of FIG. 4.

FIG. 4 shows the snap-on tray 21 and its support arms 17 along with seat cushion 22 and back cushion 23 while FIG. 5 shows a sectional view of the connection between snap-on tray 21 and support member 17.

Figure 6:
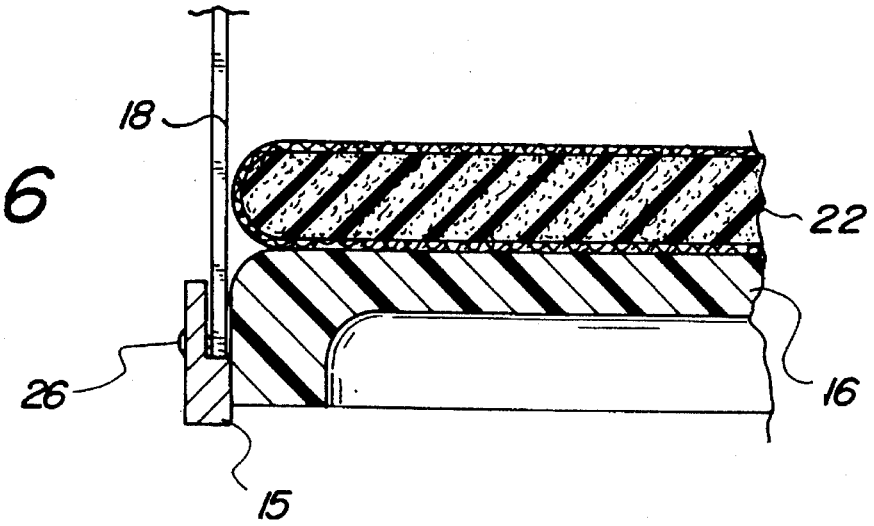
FIG. 6 is a sectional view on line 6—6 of FIG. 2.

FIG. 6 is a sectional view of the pivotal hinged connection between support arm 18 and the slideably mounted elongated base member 15 and also showing seat 16 and seat cushion 22.

Figure 7:
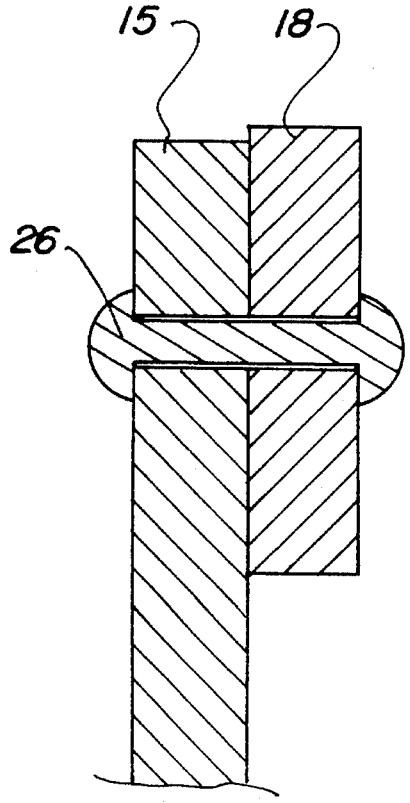
FIG. 7 is a sectional view on line 7—7 of FIG. 3.

FIG. 7 shows in section the pivotal hinged connection of the other end of support arm 18 to the tray and arm support member 17, illustrating that a rivet 26 is used as the pivot.

Figure 8:
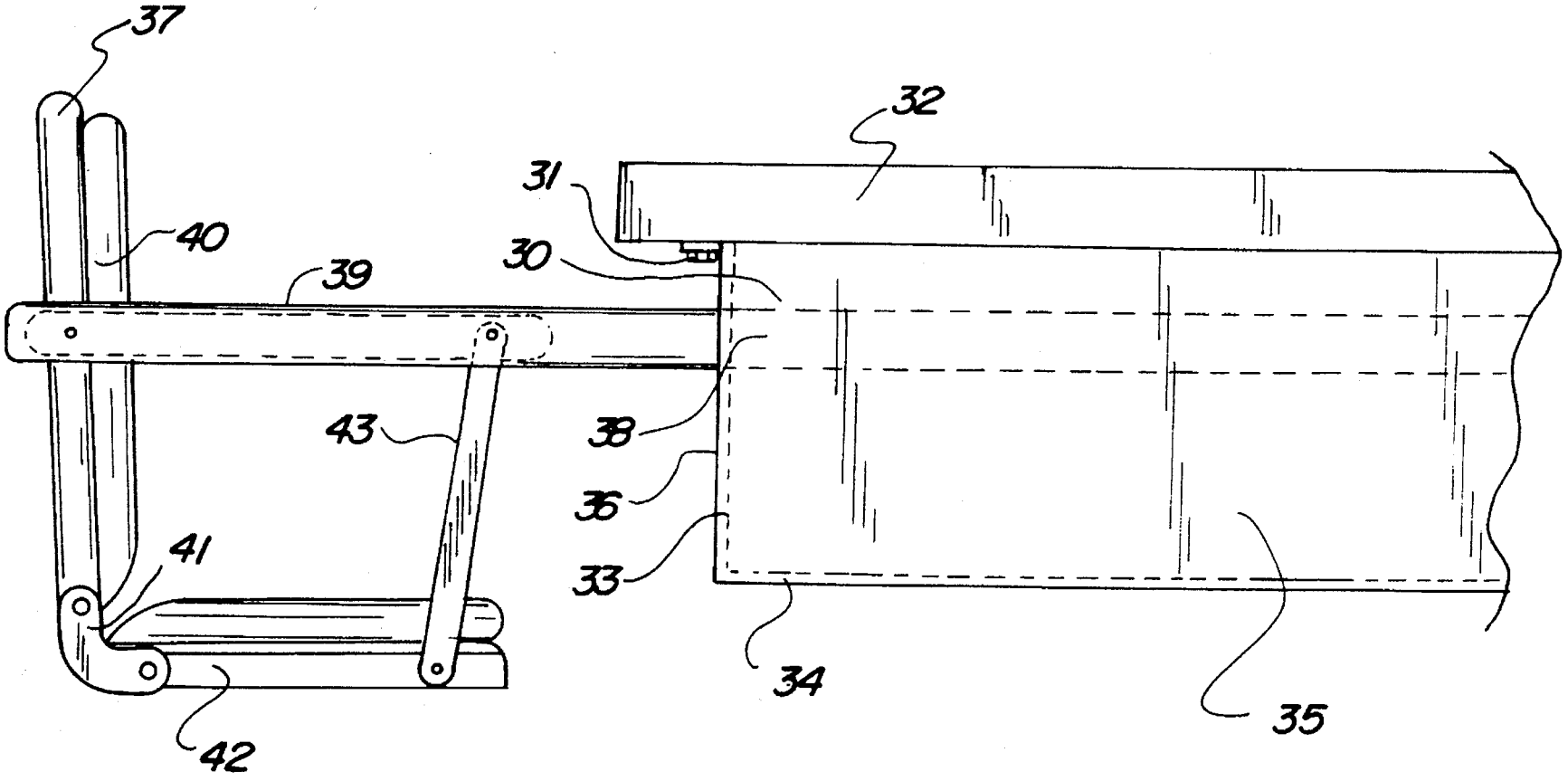
FIG. 8 is a side elevation of a modification of the present invention.

FIG. 8 illustrates the use of a bracket-mounted storage compartment 30 affixed by bolts or screws 31 to the underside of a table top 32. Compartment may be skeletal with only the ends 33 and base members 34 being solid or may have enclosed sides 35 (as shown) with only the front 36 open to receive the folding chair 37. A pair of drawer slides 38 is again utilized, here shown as mounted to the ends 33 of compartment 30. While chair 37 may be mounted on drawer slides 38 as shown in FIG. 1, the version shown here has chair 37 facing in the opposite direction and being affixed to slides 38 by engagement with support arms 39. Back rest 40 pivotally connected to support arms 39 is again hinged as at 41 to seat member 42 with a foldable support brace 43 to permit collapse of chain 37 into its storage position. In this version, with the chain 37 facing table top 32, the use of a separate feeding tray as shown in the preceding figures is not necessary, the table top 32 serving this function.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved highchair unit which comprises in combination with a cabinet having a drawer receiving compartment: a foldable chair having a back rest member connected to a seat member by a snap lock hinge, said seat member disposed between and connected to a pair of elongated base members, a pair of elongated arm support members pivotally connected to said back rest and extending parallel with and superposed above said base members in a deployed use position, a pair of pivotally mounted support arms extending between said base members and said arm support members, said pair of arm support members supporting a snap-on removeable feeding tray in said deployed use position; the back rest member positioned generally between said compartment and said seat member in said deployed use position such that a child seat occupant would face away from said compartment, and wherein the back rest member is folded downwardly toward said base member to a non-use position; a pair of full extension drawer slides mounted within said compartment and extendable therefrom though a compartment opening, said drawer slides engaging said pair of elongated base members which are slidably positioned therein for retraction of said chair into said compartment to a retracted non-use position; a conventional drawer front connected by a hinge at an upper edge thereof to an upper edge of said compartment opening and covering said opening when the highchair is in a retracted non-use position.

2. A highchair unit as in claim 1 wherein padded cushions are mounted on said seat member and said back rest member.

3. A highchair unit as in claim 1 wherein said unit in its folded position slides into and is concealed within said storage compartment.

* * * * *